US005772865A

United States Patent [19]

Tanaka et al.

[11] Patent Number: 5,772,865

[45] Date of Patent: Jun. 30, 1998

[54] ELECTROLYTIC CONVERSION SOLUTION FOR TREATING METAL SURFACE AND METHOD FOR ELECTROLYTIC CONVERSION

[75] Inventors: Shigemi Tanaka; Akira Hashimoto; Masaru Kawai; Yukihisa Toyoda, all of Tokyo, Japan

[73] Assignee: Dipsol Chemicals Co., Ltd., Tokyo, Japan

[21] Appl. No.: 717,726

[22] Filed: Sep. 23, 1996

[30] Foreign Application Priority Data

Oct. 4, 1995 [JP] Japan ..... 7-257498

[51] Int. Cl.[6] ..... C23C 22/07

[52] U.S. Cl. ..... 205/261; 205/704; 205/724; 252/62.2

[58] Field of Search ..... 205/261, 704, 205/724; 252/62.2

[56] References Cited

U.S. PATENT DOCUMENTS 4,264,378 4/1981 Oppen et al. ..... 148/6.15 R 5,089,349 2/1992 Kaiser ..... 428/472.1

5,238,505 8/1993 Kaiser ..... 148/259

FOREIGN PATENT DOCUMENTS 63-100194 5/1988 Japan .

*Primary Examiner*—Arun S. Phasge

*Attorney, Agent, or Firm*—Oblon, Spivak, McClelland, Maier & Neustadt, P.C.

[57] ABSTRACT

An electrolytic conversion solution for metal surface treatment comprises (A) a vanadate or a vanadium salt of an inorganic acid and (B) an organic acid having a reducing ability, and has a pH of not less than 7. The electrolytic conversion solution can be employed in a method for electrolytic conversion treatment which comprises the steps of immersing a subject to be treated in the treating solution and then cathodically electrolyzing the subject in the solution. The electrolytic conversion solution is free of any chromate compound and permits the formation of uniform corrosion-resistant film on the surfaces of various kinds of metallic materials without impairing the working environment and causing any environmental pollution.

13 Claims, No Drawings

ELECTROLYTIC CONVERSION SOLUTION FOR TREATING METAL SURFACE AND METHOD FOR ELECTROLYTIC CONVERSION

BACKGROUND OF THE INVENTION

The present invention relates to an electrolytic conversion solution for treating the surface of metals, which permits the formation of beautiful and corrosion-resistant protective film of, for instance, Zn, Al, Mg and the like on the surface of metals.

There have conventionally been known chromate treatments as methods for forming corrosion-resistant protective film on the surface of metals. For instance, the chromate treatment as a post-treatment for zinc plating permits an increase in the corrosion resistance by several times that observed for the zinc plated film free of such a post-treatment and can thus impart beautiful lustrous surfaces to metals.

However, the chromium compounds used in this method are harmful, in particular, hexavalent chromium is harmful to human health and therefore, the use thereof becomes a cause of environmental pollution. For this reason, the treatments using harmful heavy metals such as chromium should urgently be replaced with those using safe treating solutions.

Under such circumstances, there has been proposed an electrolytic conversion solution for treating the surface of metals, which is free of any chromium compound. For instance, Japanese Un-Examined Patent Publication (hereinafter referred to as "J.P. KOKAI") No. Sho 63-100194 proposes a bath comprising a member selected from the group consisting of silica, titanium and aluminum colloid; and a member selected from the group consisting of molybdates, tungstates and vanadates and a method for forming a film through cathodic electrolyzation using the foregoing bath.

It has generally been known that the thicker the electrolytic conversion film, the higher the corrosion resistance of the resulting metal surface. However, this method suffers from a new problem such that the film formed by this method is insufficient in the adhesion and accordingly, the method permits the formation of only a thin film.

SUMMARY OF THE INVENTION

Accordingly, it is an object of the present invention to provide a chromium-free electrolytic conversion solution for treating the surface of metals, which can improve the corrosion resistance of the metal surface and the adhesion between the surface and the resulting conversion film and can impart beautiful appearance to the surface.

Another object of the present invention is to provide a method for efficient electrolytic conversion treatment using the foregoing treating solution.

These and other objects of the present invention will be apparent from the following description and Examples.

The present invention has been completed on the basis of the finding that the foregoing drawbacks associated with the conventional techniques can effectively be eliminated by the use of a combination of a vanadate and/or a vanadium salt with an inorganic acid and an organic acid having a high reducing ability and by limiting the pH of the solution to a specific range.

According to an aspect of the present invention, there is provided an electrolytic conversion solution for use in metal surface-treatment which comprises (A) a vanadate or a vanadium salt of an inorganic acid and (B) an organic acid having a reducing ability, and having a pH of not less than 7.

According to another aspect of the present invention, there is provided a method for electrolytic conversion treatment which comprises immersing a subject to be treated in the foregoing treating solution and then cathodically electrolyzing the subject therein.

DESCRIPTION OF THE PREFERRED EMBODIMENTS

The present invention will hereinafter be explained in detail with reference to specific embodiments.

The vanadates usable in the present invention may be soluble salts of vanadic acid. Specific examples thereof include potassium vanadate, sodium vanadate and ammonium vanadate, which may be used alone or in any combination. In addition, a vanadium salt with an inorganic acid usable in the present invention may be soluble vanadium salts. Specific examples of the vanadium salts of inorganic acids are vanadium sulfate, vanadium chloride and vanadium nitrate, which may likewise be used alone or in any combination. In the present invention, vanadates is particularly preferably used.

In the present invention, the amount of the vanadate and/or the vanadium salt of an inorganic acid may arbitrarily be chosen, but preferably 1 to 100 g/l, more preferably 5 to 50 g/l as expressed in terms of the amount of vanadate ions.

In the treating solution of the invention, an organic acid having a reducing ability is used in combination with the foregoing component. The organic acid having a reducing ability may be water-soluble and preferably having carboxylic acid. Examples of such organic acids having reducing abilities are L-ascorbic acid, tannic acid and gallic acid, which may be used alone or in combination. The amount of the organic acid is not restricted to a specific range, but preferably ranges from 0.1 to 50 g/l and more preferably 1 to 5 g/l.

The pH value of the electrolytic conversion solution for metal surface-treatment is not less than 7 and preferably 7 to 12. The pH of the solution can be adjusted using an alkaline agent such as aqueous ammonia, sodium hydroxide and/or potassium hydroxide.

The treating solution of the invention comprises the foregoing components and a balance of water.

The treating solution of the invention may further comprise, as optional components, substances each having a reducing ability such as formalin and/or hydrosulfites ($Na_2S_2O_4$).

As to the effect of the organic acid having a reducing ability used in the invention, it would be assumed that the vanadate ions present in the bath are reduced from their higher valency state to the lower valency state and accordingly, a film can easily be formed on the cathode. For this reason, if carrying out a continuous treatment in the absence of any organic acid having a reducing ability, vanadium is oxidized on the anode, this results in a decrease in the amount of vanadium having a lower valency in the bath and the thickness of the resulting electrolytic conversion film is correspondingly reduced as the treatment proceeds. However, the electrolytic conversion solution of the invention permits a continuous treatment while ensuring the formation of the film having a uniform thickness.

The electrolytic conversion solution for metal surface-treatment according to the present invention permits the formation of corrosion-resistant and beautiful protective film on the surfaces of various metals. In particular, the surfaces to be treated according to the present invention include those of Zn-plated films such as electrolytically plated Zn films and hot-dipped Zn films; those of zinc alloy-plated films such as electrolytically plated zinc alloy films and hot-dipped zinc alloy films; those of Al and Al alloys; those of Mg and Mg alloys; and those of Cu and Ag.

In the present invention, parts having the foregoing metal surfaces as the subject to be treated are immersed in the foregoing electrolytic conversion solution for metal surface-treatment and then cathodically electrolyzing the parts in the solution to form a corrosion-resistant beautiful protective film on the metal surface, for instance, a vanadium oxide film having a thickness of the order of 0.2 to 2 $\mu$m.

More specifically, the cathodic electrolyzation is carried out using the part having the foregoing metal surface as a cathode while using, for instance, iron, stainless steel, platinum, lead, nickel or carbon as an anode. The cathodic electrolyzation can be carried out under any conditions, but is in general carried out at an ordinary temperature (5° to 30° C.), a current density of from 0.5 to 20 A/dm$^2$ for 10 to 600 seconds (preferably 60 to 180 seconds) to form a corrosion-resistant protective film on metal surfaces.

As has been discussed above in detail, the present invention can provide an electrolytic conversion solution for metal surface-treatment, which is free of any chromate compound and which permits the formation of uniform corrosion-resistant film on the surfaces of various kinds of metallic materials without impairing the working environment and causing any environmental pollution.

The present invention will now be described in more detail with reference to the following working Examples and Comparative Examples.

EXAMPLE 1

There were dissolved, in one liter of water, 6 g of ammonium vanadate and 2 g of L-ascorbic acid to thus prepare an electrolytic conversion solution for metal surface-treatment. The pH value thereof was adjusted to 7.

A steel plate which had been plated with a zinc film having a thickness of 8 $\mu$m was immersed in the treating solution and the plate which served as a cathode was cathodically electrolyzed, in the solution, at an electrolyzing temperature of 25° C., a corrent density of 3 A/dm$^2$ for 120 seconds while using an iron plate as an anode to thus form a colored film having uniform appearance on the steel plate provided with the zinc plated film.

The above-mentioned procedures were repeated 5 times using the same treating solution and a colored film having uniform appearance was still formed in the 5th cycle (i.e., the solution did not show any change in the film-forming characteristics even when the film-forming cycles were repeated 2 to 5 times).

EXAMPLE 2

The same procedures used in Example 1 were repeated one time except that 14 g of potassium vanadate and 2 g of L-ascorbic acid were dissolved in one liter of water to give an electrolytic conversion solution for metal surface-treatment (pH 7) and a current density of 1.5 A/dm$^2$ was used in the cathodic electrolyzation to thus give a colored film having uniform appearance.

The above-mentioned procedures were repeated 5 times using the same treating solution and a colored film having uniform appearance was still formed in the 5th cycle (i.e., the solution did not show any change in the film-forming characteristics even when the film-forming cycles were repeated 2 to 5 times).

EXAMPLE 3

The same procedures used in Example 2 were repeated one time except that the cathodic electrolyzation was carried out at a current density of 3 A/dm$^2$ for 60 seconds to thus give a colored film having uniform appearance.

EXAMPLE 4

The same procedures used in Example 3 were repeated except that the electrolyzation time was changed to 120 seconds to thus give a mud yellow-colored film having uniform appearance.

The above-mentioned procedures were repeated 5 times using the same treating solution and a blond-colored film having uniform appearance could be obtained even in the 5th cycle (i.e., the solution did not show any change in the film-forming characteristics even when the film-forming cycles were repeated 2 to 5 times).

EXAMPLE 5

The procedures used in Example 4 were repeated one time except that an electrolytic conversion solution was prepared by dissolving 12 g of ammonium vanadate, 5 g of sodium hydroxide and 2 g of L-ascorbic acid in one liter of water (pH 10) to thus give a blond-colored film having uniform appearance.

EXAMPLE 6

The procedures used in Example 4 were repeated one time except that an electrolytic conversion solution was prepared by dissolving 24 g of ammonium vanadate, 5 g of sodium hydroxide and 2 g of L-ascorbic acid in one liter of water (pH 10) to thus give a blond-colored film having uniform appearance.

EXAMPLE 7

The procedures used in Example 4 were repeated one time except that an electrolytic conversion solution was prepared by dissolving 36 g of ammonium vanadate, 10 g of sodium hydroxide and 2 g of L-ascorbic acid in one liter of water (pH 12) to thus give a blond-colored film having uniform appearance.

The above-mentioned procedures were repeated 5 times using the same treating solution and a colored film having uniform appearance was still formed in the 5th cycle (i.e., the solution did not show any change in the film-forming characteristics even when the film-forming cycles were repeated 2 to 5 times).

EXAMPLE 8

The procedures used in Example 4 were repeated one time except that an electrolytic conversion solution was prepared by dissolving 12 g of ammonium vanadate and 1 g of gallic acid in one liter of water (pH 7) to thus give a mud yellow-colored film having uniform appearance.

EXAMPLE 9

The procedures used in Example 4 were repeated one time except that an electrolytic conversion solution was prepared by dissolving 12 g of potassium vanadate and 1 g of tannic acid in one liter of water (pH 7) to thus give a mud yellow-colored film having uniform appearance.

The above-mentioned procedures were repeated 5 times using the same treating solution and a colored film having uniform appearance was still formed in the 5th cycle (i.e., the solution did not show any change in the film-forming characteristics even when the film-forming cycles were repeated 2 to 5 times).

EXAMPLE 10

The procedures used in Example 4 were repeated one time except that an electrolytic conversion solution was prepared by dissolving 12 g of ammonium vanadate and 2 g of L-ascorbic acid in one liter of water (pH 7) to thus give a blond-colored film having uniform appearance.

EXAMPLE 11

The procedures used in Example 9 were repeated one time except for using a steel plate which had been plated with a Zn-Ni film having a thickness of 8 $\mu$m was used as the subject to be treated to thus give a blond-colored film having uniform appearance.

EXAMPLE 12

The procedures used in Example 9 were repeated one time except for using an Al plate of JIS 104 as the subject to be treated to thus give a blond-colored film having uniform appearance.

EXAMPLE 13

The procedures used in Example 4 were repeated one time except that an electrolytic conversion solution was prepared by dissolving 10 g of vanadium sulfate and 2 g of L-ascorbic acid in one liter of water (pH 12) to thus give a colored film having uniform appearance.

Comparative Example 1

As a comparative sample, there was used a steel plate which had been plated with a zinc film having a thickness of 8 $\mu$m, as such, without subjecting it to any electrolytic conversion for metal surface-treatment.

Comparative Example 2

As a comparative sample, there was used a steel plate which had been plated with a Zn-Ni film having a thickness of 8 $\mu$m, as such, without subjecting it to any electrolytic conversion for metal surface-treatment.

Comparative Example 3

As a comparative sample, there was used an Al plate of JIS 104, as such, without subjecting it to any electrolytic conversion for metal surface-treatment.

Comparative Example 4

The procedures used in Example 4 were repeated one time except that an electrolytic conversion solution was prepared by dissolving 14 g of potassium vanadate in one liter of water (pH 7) to thus give a mud yellow-colored film having uniform appearance.

The above-mentioned procedures were repeated 5 times using the same treating solution (while changing the plate to be treated and serving as the cathode for fresh one for each cycle) and a colored film having non-uniform appearance was formed in the 5th cycle (i.e., the formation of films became difficult as the film-forming cycles were repeated 2 to 5 times).

The films obtained in the foregoing Examples and Comparative Examples were inspected for the durability by the salt spray test as specified in JIS H-8610. More specifically, the durability was evaluated on the basis of the white rust-forming time which was defined to be the time required for forming white rust on 5% of the total surface of each sample. The results thus obtained are listed in the following Table 1.

TABLE 1

| | 5% White Rust-Forming Time (hour) | |
|---|---|---|
| Specimen (Ex. No.) | 1 time spec. | 5 time repeated spec. |
| Example 1 | 72 | 72 |
| Example 2 | 72 | 72 |
| Example 3 | 72 | — |
| Example 4 | 120 | 120 |
| Example 5 | 120 | — |
| Example 6 | 120 | — |
| Example 7 | 120 | 120 |
| Example 8 | 120 | — |
| Example 9 | 120 | 120 |
| Example 10 | 120 | — |
| Example 11 | 96 | — |
| Example 12 | 72 | — |
| Example 13 | 72 | — |
| Comp. Example 1 | not more than 1 | — |
| Comp. Example 2 | not more than 1 | — |
| Comp. Example 3 | not more than 1 | — |
| Comp. Example 4 | 96 | 24 |

What is claimed is:

1. An electrolytic conversion solution for metal surface treatment comprising (A) a vanadate or a vanadium salt of an inorganic acid in an amount of 5 to 50 gl, (B) an organic acid having a reducing ability in an amount of 0.1 to 50 g/l, and a balance of water, and having a pH of not less than 7, and being free of tellurium and selenium.

2. The electrolytic conversion solution of claim 1 wherein ingredient (A) is selected from the group consisting of potassium vanadate, sodium vanadate, ammonium vanadate and vanadium sulfate.

3. The electrolytic conversion solution of claim 1 wherein ingredient (B) is L-ascorbic acid, tannic acid or gallic acid.

4. The electrolytic conversion solution of claim 1 wherein it has a pH ranging from 7 to 12 and it is free of chromate compound.

5. An electrolytic conversion solution for metal surface treatment comprising (A) 5 to 50 g/l of a vanadate or a vanadium salt of an inorganic acid and (B) 0.1 to 50 g/l of an organic acid having a reducing ability selected from the group consisting of L-ascorbic acid, tannic acid and gallic acid, and a balance of water, and having a pH of 7 to 12, the solution being free of chromate compound, tellurium and selenium.

6. The electrolytic conversion solution of claim 5 wherein ingredient (A) is selected from the group consisting of potassium vanadate, sodium vanadate, ammonium vanadate and vanadium sulfate.

7. A method for electrolytic conversion treatment comprising the steps of immersing a subject to be treated in a treating solution which comprises (A) a vanadate or a vanadium salt of an inorganic acid and (B) an organic acid having a reducing ability, and having a pH of not less than 7, and then cathodically electrolyzing the subject in the solution.

8. The method of claim 7 wherein the surface to be treated is a member selected from the group consisting of those of Zn-plated films, zinc alloy-plated films, Al and Al alloys.

9. The method of claim 7 wherein the cathodic electrolyzation is carried out at a temperature ranging from 5° to 30° C. and a current density ranging from 0.5 to 20 $A/dm^2$ for 60 to 180 seconds.

10. The method of claim 7 wherein ingredient (A) is selected from the group consisting of potassium vanadate, sodium vanadate, ammonium vanadate and vanadium sulfate.

11. The method of claim 7 wherein ingredient (B) is L-ascorbic acid, tannic acid or gallic acid.

12. The method of claim 7 wherein ingredient (A) is in an amount of 5 to 50 g/l and ingredient (B) is 0.1 to 50 g/l.

13. The method of claim 7 wherein the electrolytic conversion solution comprises (A) 5 to 50 g/l of a vanadate or a vanadium salt of an inorganic acid and (B) 0.1 to 50 g/l of an organic acid having a reducing ability selected from the group consisting of L-ascorbic acid, tannic acid and gallic acid, and a balance of water, and having a pH of 7 to 12, the solution being free of chromate compound.

* * * * *